US011964193B2

(12) United States Patent
Mazursky et al.

(10) Patent No.: US 11,964,193 B2
(45) Date of Patent: Apr. 23, 2024

(54) SYSTEMS AND METHODS FOR SELECTIVELY ENHANCING THE WEIGHT AND AERODYNAMICS OF SPORTING EQUIPMENT

(71) Applicant: PDQ MAZOO, LLC, Northbrook, IL (US)

(72) Inventors: Richard B. Mazursky, Northbrook, IL (US); Tony J. Abfall, Mt. Prospect, IL (US); Michael S. Carrico, Park Ridge, IL (US)

(73) Assignee: PDQ MAZOO, LLC, Northbrook, IL (US)

( * ) Notice: Subject to any disclaimer, the term of this patent is extended or adjusted under 35 U.S.C. 154(b) by 589 days.

(21) Appl. No.: 16/289,895

(22) Filed: Mar. 1, 2019

(65) Prior Publication Data

US 2019/0269986 A1 Sep. 5, 2019

Related U.S. Application Data

(60) Provisional application No. 62/637,813, filed on Mar. 2, 2018.

(51) Int. Cl.
*A63B 59/48* (2015.01)
*A63B 60/08* (2015.01)
(Continued)

(52) U.S. Cl.
CPC ..... *A63B 59/48* (2015.10); *A63B 60/08* (2015.10); *A63B 2102/08* (2015.10);
(Continued)

(58) Field of Classification Search
CPC ..... A63B 2102/22; A63B 59/48; A63B 60/48; A63B 2102/08; A63B 2102/16; A42B 3/20; A63C 5/07
(Continued)

(56) References Cited

U.S. PATENT DOCUMENTS 877,061 A * 1/1908 Earnest ..... B42F 13/12 411/338
1,120,367 A * 12/1914 Booraem ..... F16B 13/068 411/26

(Continued)

FOREIGN PATENT DOCUMENTS

GB 1127473 9/1968

OTHER PUBLICATIONS

Zitzewitz, Paul W., "The Handy Physics Answer Book," Chapter entitled "What is the most aerodynamic shape?" Feb. 27, 2019, 2 pages.

(Continued)

*Primary Examiner* — Melba Bumgarner
*Assistant Examiner* — Rayshun K Peng
(74) *Attorney, Agent, or Firm* — McAndrews, Held & Malloy, Ltd.

(57) ABSTRACT

Systems and methods for selectively enhancing the weight and aerodynamics of sporting equipment are provided. A system may include a piece of sporting equipment having openings extending through the sporting equipment. The system may include a plug operable to be secured within one of the openings extending through the sporting equipment. The plug may include a first end portion, a second end portion, and an attachment mechanism. The first end portion may include a first outer flange and a first body. The first outer flange may have a larger diameter than the first body. The second end portion may include a second outer flange and a second body. The second outer flange may have a larger diameter than the second body. The attachment mechanism may be configured to connect the first end portion to the second end portion to secure the plug within the one of the openings.

25 Claims, 7 Drawing Sheets

(51) Int. Cl.
*A63B 102/08* (2015.01)
*A63B 102/16* (2015.01)
*A63B 102/22* (2015.01)
*A63B 102/24* (2015.01)

(52) U.S. Cl.
CPC ..... *A63B 2102/16* (2015.10); *A63B 2102/22* (2015.10); *A63B 2102/24* (2015.10)

(58) Field of Classification Search
USPC ..... 473/415, 530; 411/433, 389, 383, 268, 411/265, 118, 63, 26, 338; 292/164, 155, 292/115
See application file for complete search history.

(56) References Cited

U.S. PATENT DOCUMENTS 1,133,129 A * 3/1915 Govan
3,054,320 A * 9/1962 Dickow ..... F16B 13/068 411/26
3,652,094 A 3/1972 Glover
3,863,917 A 2/1975 Beale
3,873,094 A * 3/1975 Sebo ..... A63B 53/0487 473/250
4,052,075 A 10/1977 Daly
4,130,277 A * 12/1978 Marks ..... A63B 60/08 473/527
4,379,554 A * 4/1983 Schuyler ..... A63B 59/40 473/530
4,563,020 A * 1/1986 Arieh ..... F16F 7/108 280/602
5,078,396 A * 1/1992 Cavallaro ..... A63B 59/70 473/561
5,346,219 A * 9/1994 Pehoski ..... A63B 53/0487 473/325
5,429,352 A * 7/1995 Leclerc ..... A63B 60/52 473/563
5,571,053 A 11/1996 Lane
5,688,189 A 11/1997 Bland
7,530,910 B1 * 5/2009 Niksich ..... A63B 69/38 473/522
8,777,537 B2 * 7/2014 Fritsch ..... F16B 5/02 411/338
2008/0039229 A1 2/2008 Lo
2008/0132353 A1 * 6/2008 Hsiao ..... A63B 53/0466 473/336
2012/0233838 A1 9/2012 Swist
2013/0225337 A1 * 8/2013 Kitchen ..... A63B 49/022 473/540
2014/0349779 A1 11/2014 Mizutani
2016/0339312 A1 * 11/2016 Bonfigli ..... A63B 49/035
2019/0046849 A1 * 2/2019 Cemel ..... A63B 60/42

OTHER PUBLICATIONS

Huera-Huarte, Francisco J., "Some Observations on the Flow Physics of Paddle Racquets," Published online at http://pip.sagepub.com/content/early/2013/08/29/1754337113499324, under Proceedings of the Institution of Mechanical Engineers, Part P: Journal of Sports Engineering and Technology, Sep. 10, 2013, pp. 1-9.
PCT, Notification of Transmittal of The International Search Report and the Written Opinion of the International Searching Authority, or The Declaration, in Application No. PCT/US19/20235, dated May 3, 2019 (10 pages).
PCT, Notification Concerning Transmittal of Copy of International Preliminary Report on Patentability (Chapter I of the Patent Cooperation Treaty) in Application No. PCT/US19/20235, dated Sep. 17, 2020 (9 pages).

* cited by examiner

SYSTEMS AND METHODS FOR SELECTIVELY ENHANCING THE WEIGHT AND AERODYNAMICS OF SPORTING EQUIPMENT

CROSS-REFERENCE TO RELATED APPLICATIONS/INCORPORATION BY REFERENCE

The present application claims priority under 35 U.S.C. § 119(e) to provisional application Ser. No. 62/637,813 filed on Mar. 2, 2018, entitled "SYSTEMS AND METHODS FOR SELECTIVELY ENHANCING AERODYNAMICS OF SPORTING EQUIPMENT." The above referenced provisional application is hereby incorporated herein by reference in its entirety.

FIELD

Certain embodiments relate to sporting equipment. More specifically, certain embodiments relate to systems and methods for selectively enhancing the weight and aerodynamics of sporting equipment.

BACKGROUND

Sporting equipment may be provided with openings to enhance the aerodynamics of the sporting equipment. The sporting equipment may include platform tennis paddles, hockey stick blades and shafts, pickleball paddles, baseball/softball bat barrels, tennis racquet shafts and webbing, canoe paddle blades, boat oars, and/or any suitable sporting equipment.

Existing platform tennis paddles have openings extending through one or more of the playing surface, frame, bridge/throat, and/or handle/grip. FIG. 1 is a front view of a platform tennis paddle 10, as known in the art. Referring to FIG. 1, the paddle 10 may have a handle portion 12 and a head portion 20. The handle portion 12 may include a grip 14 to grasp by a user of the paddle 10 and a bridge/throat 16 coupling the handle portion 12 to the head portion 20. The head portion 16 may include a frame 22 and playing surfaces 24 on a front and rear of the paddle 10. A number of cylindrically-shaped openings 26 may extend through the head 20 and be distributed on the playing surfaces 24 of the paddle 10. The openings 26 form a right angle to the playing surfaces 24 of the paddle 10. However, the cylindrical shape and 90 degree angle of the openings 26 may not be the most efficient use of air flow through the paddle 10 as discussed in "What is the most aerodynamic shape?" The Handy Physics Answer Book, Fluids, Aerodynamics, which is incorporated herein by reference in its entirety. Moreover, the positioning of the openings 26 at or around the center of the playing surfaces 24 may be detrimental to the performance of the paddle 10. For example, the openings 26 at the center of the paddle 10 may provide less rigidity, more damping, and shorter paddle life as discussed in "Some observations on the flow physics of paddle racquets," Proceedings of the Institution of Mechanical Engineers, Part P: Journal of Sports Engineering and Technology, Sep. 10, 2013, which is incorporated herein by reference in its entirety.

Platform tennis paddles 10 and other sporting equipment also typically come in pre-defined weights. A user that would like to use paddles 10 or other pieces of sporting equipment having a variety of weights to adjust for weather conditions, swing, grip, balance, and the like, may have to purchase multiple pieces of the sporting equipment having the desired weights. Similarly, a seller may need to carry additional inventory corresponding to the paddles 10 having different weights.

Further limitations and disadvantages of conventional and traditional approaches will become apparent to one of skill in the art, through comparison of such systems with some aspects of the present disclosure as set forth in the remainder of the present application.

SUMMARY

Certain embodiments provide systems and methods for selectively enhancing the weight and aerodynamics of sporting equipment, substantially as shown in and/or described in connection with at least one of the figures.

These and other advantages, aspects and novel features of the present disclosure, as well as details of an illustrated embodiment thereof, will be more fully understood from the following description and drawings.

DETAILED DESCRIPTION

Figure 1:
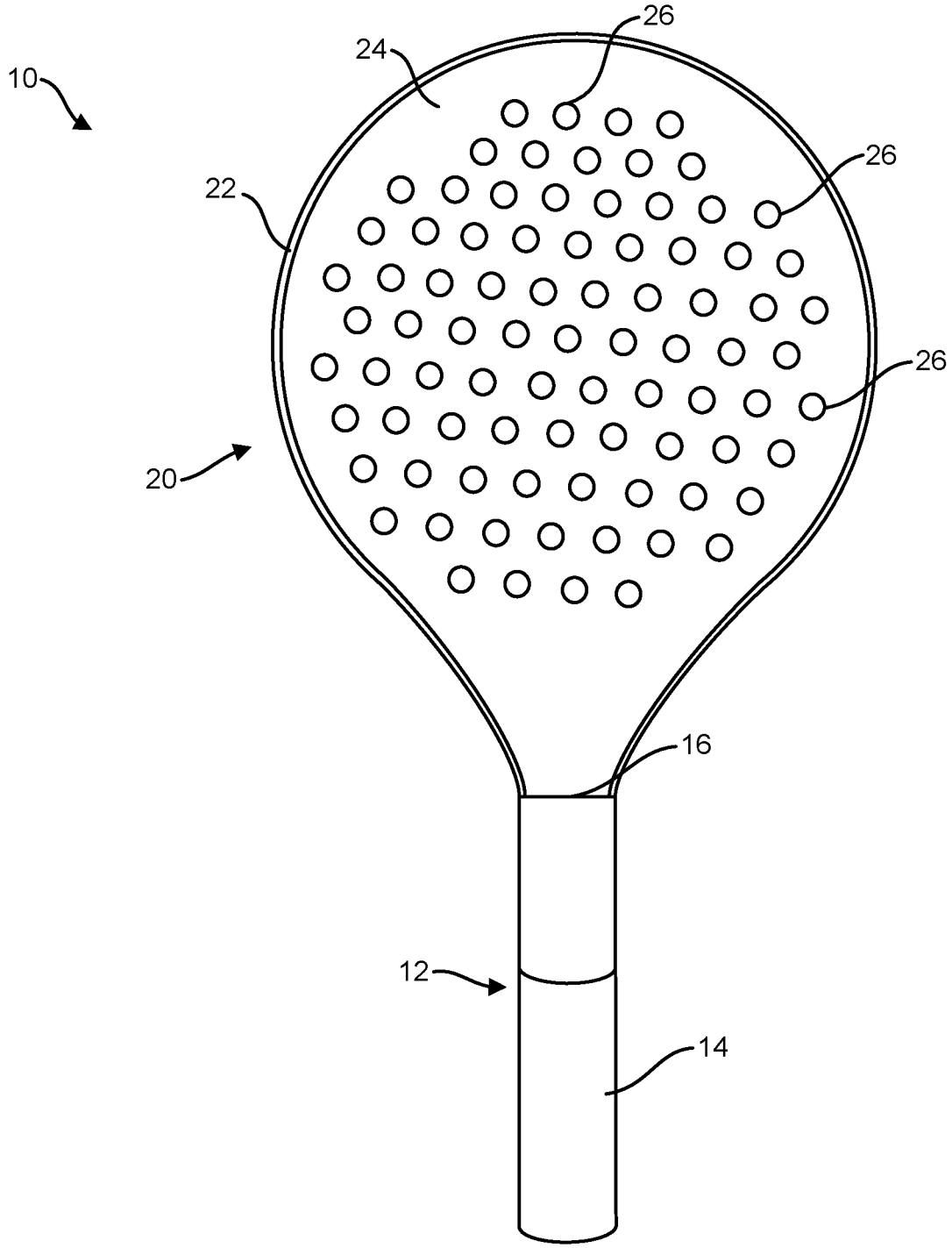
(PRIOR ART) FIG. 1
FIG. 1 is a front view of a platform tennis paddle, as known in the art.

Certain embodiments provide sporting equipment having openings modified to enhance the aerodynamics of the sporting equipment. Aspects of the present technology provide plugs secured within at least a portion of openings extending through the sporting equipment to modify the weight and aerodynamics of the sporting equipment.

The foregoing summary, as well as the following detailed description of certain embodiments will be better understood when read in conjunction with the appended drawings. It should be understood that the various embodiments are not limited to the arrangements and instrumentality shown in the drawings. It should also be understood that the embodiments may be combined, or that other embodiments may be utilized and that structural changes may be made without departing from the scope of the various embodiments of the present disclosure. The following detailed description is, therefore, not to be taken in a limiting sense.

Figure 2:
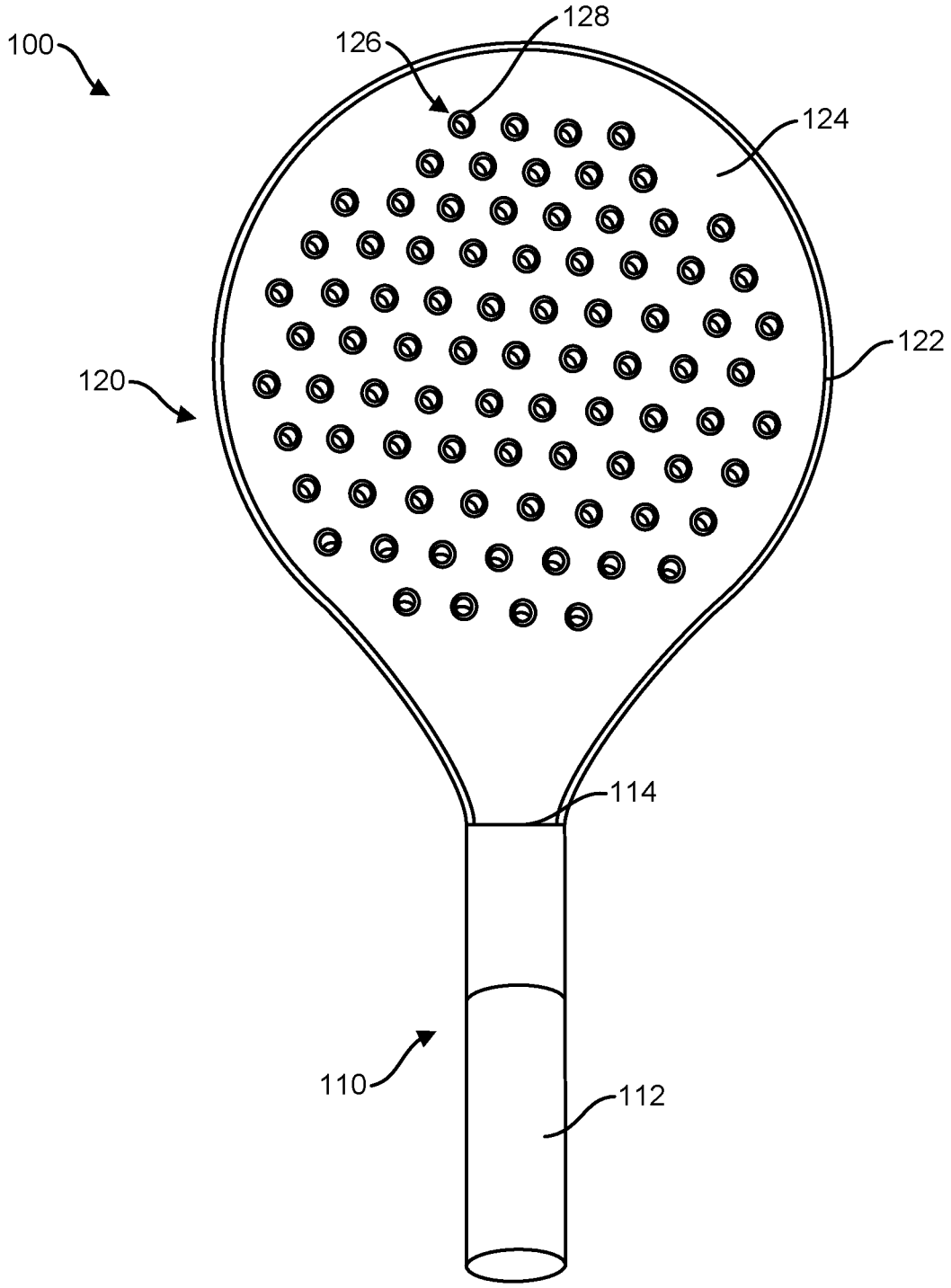
FIG. 2 is a front view of an exemplary platform tennis paddle having openings with angled surfaces distributed on a playing surface of the paddle, in accordance with various embodiments.

FIG. 2 is a front view of an exemplary platform tennis paddle 100 having openings 126 with angled surfaces 128 distributed on a playing surface 124 of the paddle 100, in accordance with various embodiments. Referring to FIG. 2, the platform tennis paddle 100 may comprise a handle portion 110 and a head portion 120. The handle portion 110 may include a grip 112 and a bridge/throat 114. The grip 112 may include a textured surface, tape, or any suitable gripping surface to be grasped by a user of the paddle 100. The bridge/throat 114 couples the handle portion 110 to the head portion 120 of the paddle 100. In certain embodiments, the handle portion 110 and head portion 120 may be an integrated component (i.e., unitary construction).

The head portion 120 may include a frame 122 and playing surfaces 124 on front and back sides of the head portion 120. In various embodiments, one or more of the head portion 120 or the handle portion 110 may include openings 126 extending through the component. For example, the openings 126 may be distributed on the playing surface 124 of the paddle 100 as shown in FIG. 2. Additionally and/or alternatively, the grip 112 and/or the bridge/throat 114 may include openings 126.

The openings 126 include angled edges 128 surrounding the outer perimeter of the openings 126 at one or both of the playing surfaces 124 that may comprise a beveled edge, chamfer, and/or channels to enhance the aerodynamics provided by the openings 126. The angled edges 128 of the openings 126 may provide enhanced aerodynamic properties. The openings 126 having the angled edges 128 may define a shape to enhance air flow through the opening 126. For example, a cross-sectional view of the openings 126 having the angled edges 128 may have an hour glass shape with the openings 126 having a larger diameter defined by the angled edges 128 at the playing surfaces 124 on each side of the paddle 100 and a smaller diameter at the center of the paddle 100 between the playing surfaces 124 on each side of the paddle 100. In various embodiments, the openings 126 may be provided in one or more shapes. For example, the openings 126 may have a tear drop shape, an oval shape, a circular shape, or any suitable shape. In an exemplary embodiment, the openings 126 may be of various sizes and may be evenly or unevenly spaced and in various geographic patterns.

In a representative embodiment, the playing surfaces 124, including areas surrounding one or more of the openings 126, may include grit or texture of any suitable density. The grit may be applied to the playing surfaces 124 and/or molded into the playing surfaces 124.

Figure 3:
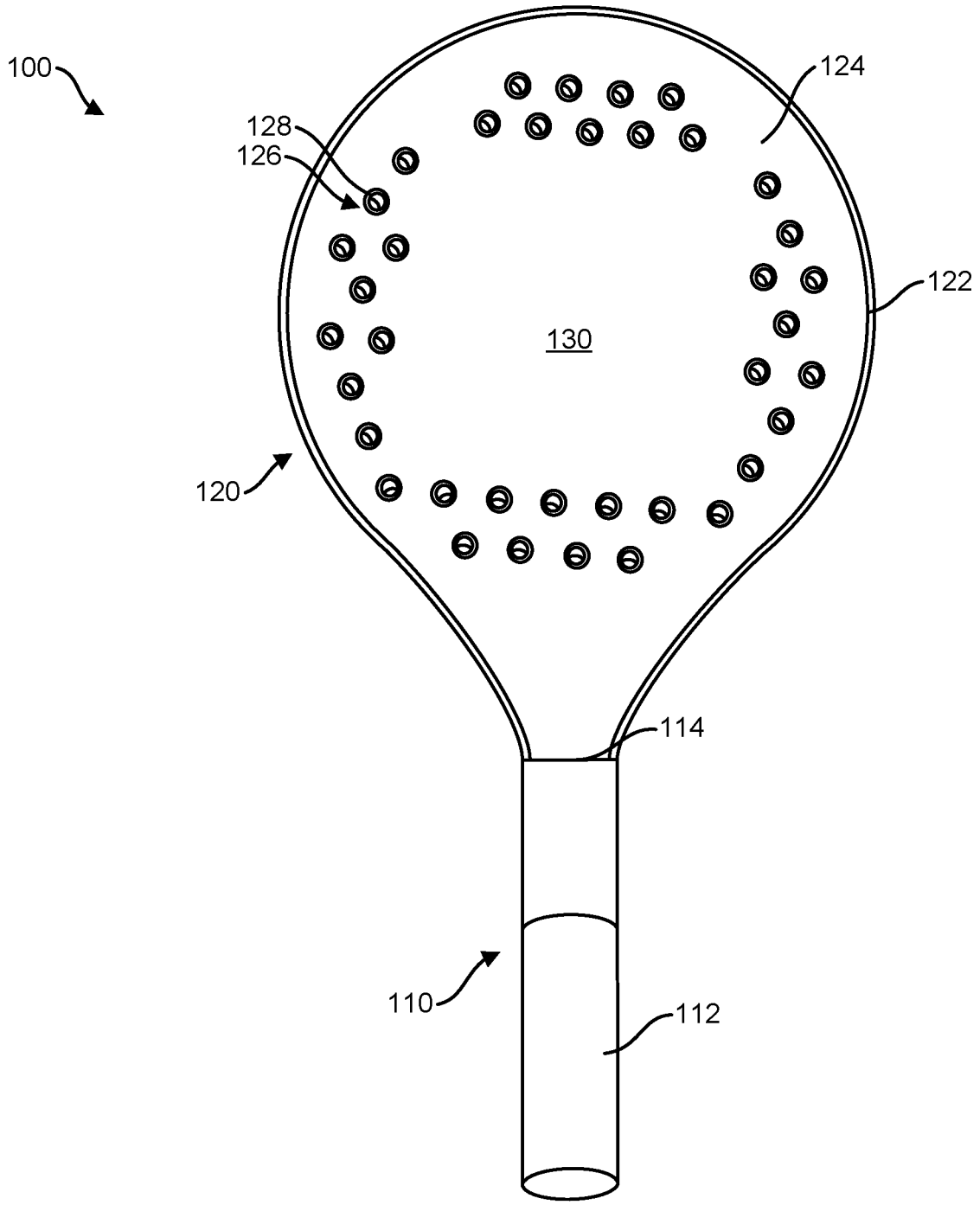
FIG. 3 is a front view of an exemplary platform tennis paddle having openings with angled surfaces arranged about a perimeter of a playing surface of the paddle, in accordance with various embodiments.

FIG. 3 is a front view of an exemplary platform tennis paddle 100 having openings 126 with angled surfaces 128 arranged about a perimeter of a playing surface 124 of the paddle 100, in accordance with various embodiments. Referring to FIG. 3, the platform tennis paddle 100 may comprise a handle portion 110 and a head portion 120. The handle portion 110 may include a grip 112 and a bridge/throat 114. The head portion 120 may include a frame 122 and playing surfaces 124 on front and back sides of the head portion 120. The playing surface 124 may include a central portion 130 and a perimeter portion adjacent the frame 122. The central portion 130 may comprise a solid playing surface (e.g., without openings). The solid playing surface at the central portion 130 of the paddle 100 may provide a more rigid paddle with less damping and can provide more durability than paddles with openings in the central portion 130. The central portion 130 and/or perimeter portion of the playing surface 124 may include grit or texture as described above.

The perimeter portion may include openings 126 extending through the paddle 100 and arranged to surround the central portion 130. The openings 126 about the perimeter of the playing surface 124 may be arranged in one to two rows to maximize the aerodynamics of the paddle 100. The openings 126 include angled surfaces 128 adjacent the playing surface 124 surrounding the openings 126 such that outer edges of the openings 126 are non-perpendicular to the playing surface 124. For example, the outer edges 128 of the openings 126 adjacent the playing surface 124 may be beveled, chamfered, or the like to provide the angled surfaces 128. The openings 126 may be of various shapes, sizes, and/or may be evenly or unevenly spaced as described above.

The platform tennis paddle 100 illustrated in FIG. 3 shares various characteristics with the platform tennis paddle 100 illustrated in FIG. 2 as described above.

Still referring to FIGS. 2 and 3, in various embodiments, the platform tennis paddle 100 may include wiring inside of the head 120 and/or handle 110. The wiring may be used to provide speakers and/or lighting positioned between the playing surfaces 124 of the paddle 100. Additionally and/or alternatively, the wiring may be used to provide a heating element in the handle portion 110 and/or head portion 120 of the paddle 100. For example, the speakers and/or lighting may be located in and/or adjacent to one or more of the openings 126. The speakers may be connected to a battery, an audio input, and/or an audio source by wired connection(s) routed inside of the paddle 100. Additionally and/or alternatively, the audio signal may be provided via a wireless connection. Sound effects may be provided via the speakers so that when the ball is struck by the paddle 100 or when the paddle 100 is in motion or stationary a sound may be initiated automatically or by a user. The lighting and/or heating element may be connected to a battery by a wired connection routed inside of the paddle 100. In various embodiments, the lighting may be light emitting diodes or any suitable lighting.

Figure 4:
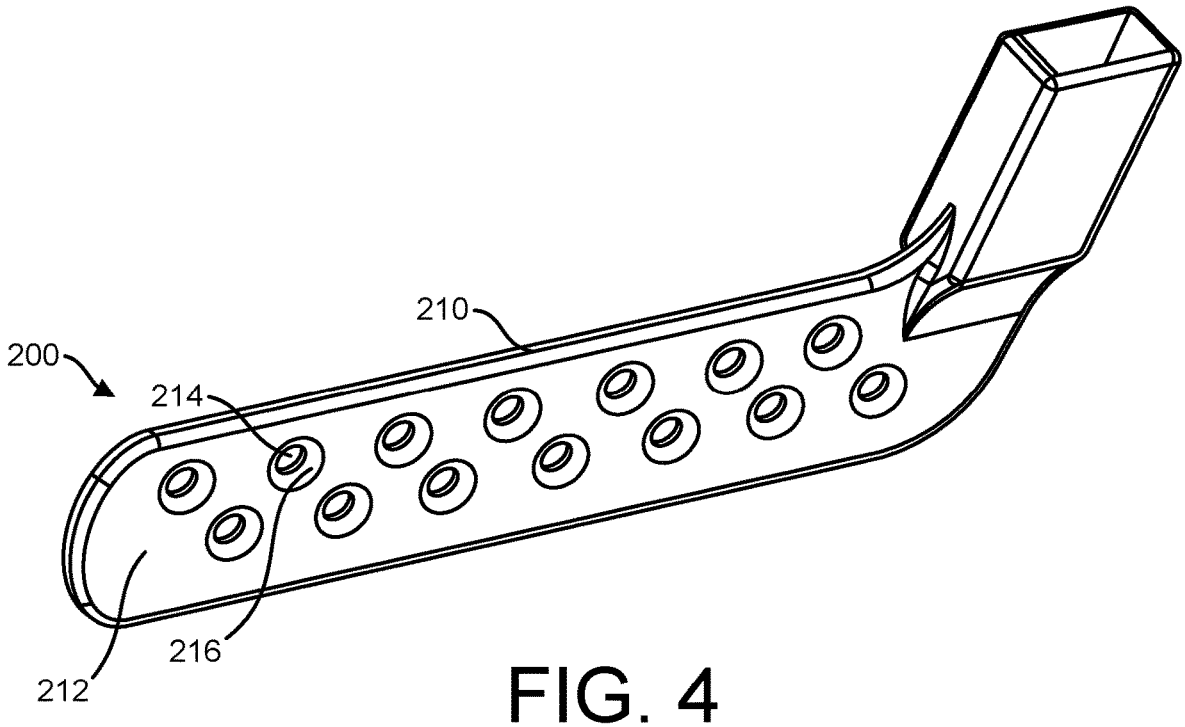
FIG. 4 is a front perspective view of an exemplary hockey stick blade having openings with angled surfaces distributed on a playing surface of the blade, in accordance with various embodiments.
Figure 5:
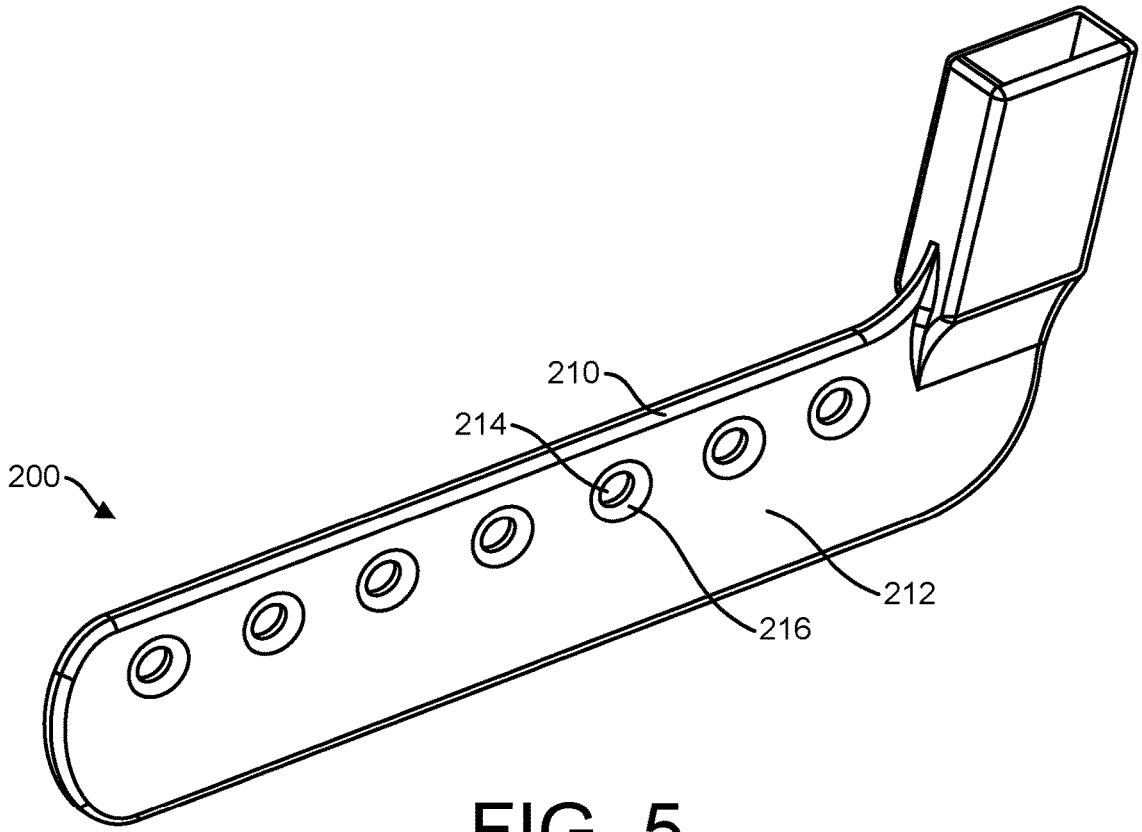
FIG. 5 is a front perspective view of an exemplary hockey stick blade having openings with angled surfaces arranged across a top portion of a playing surface of the blade, in accordance with various embodiments.
Figure 6:
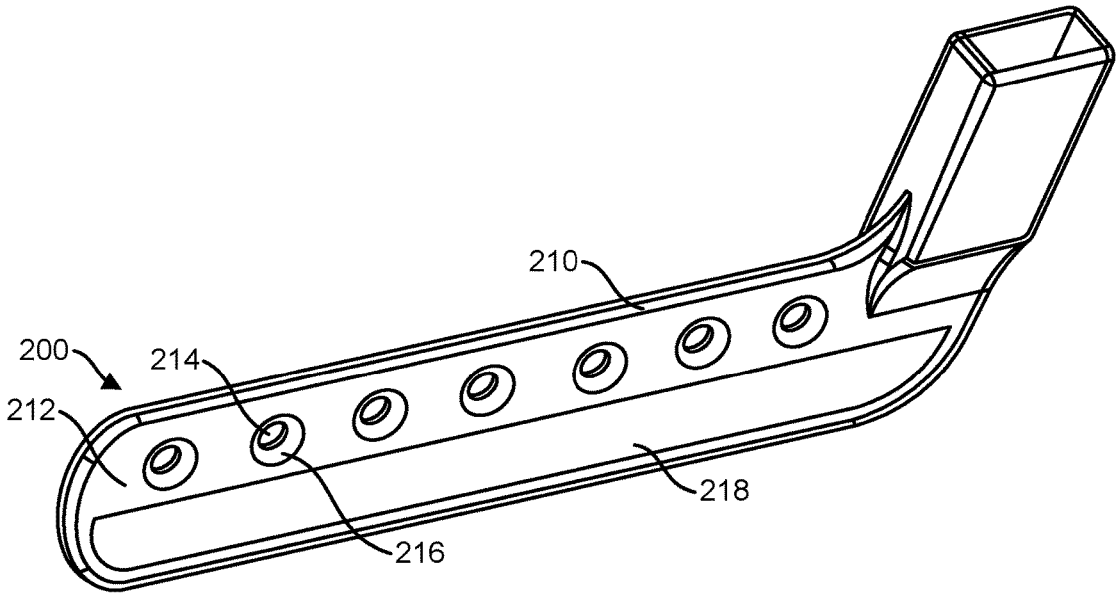
FIG. 6 is a front perspective view of an exemplary hockey stick blade having openings with angled surfaces arranged across a top portion and grip arranged across a bottom portion of a playing surface of the blade, in accordance with various embodiments.
Figure 7:
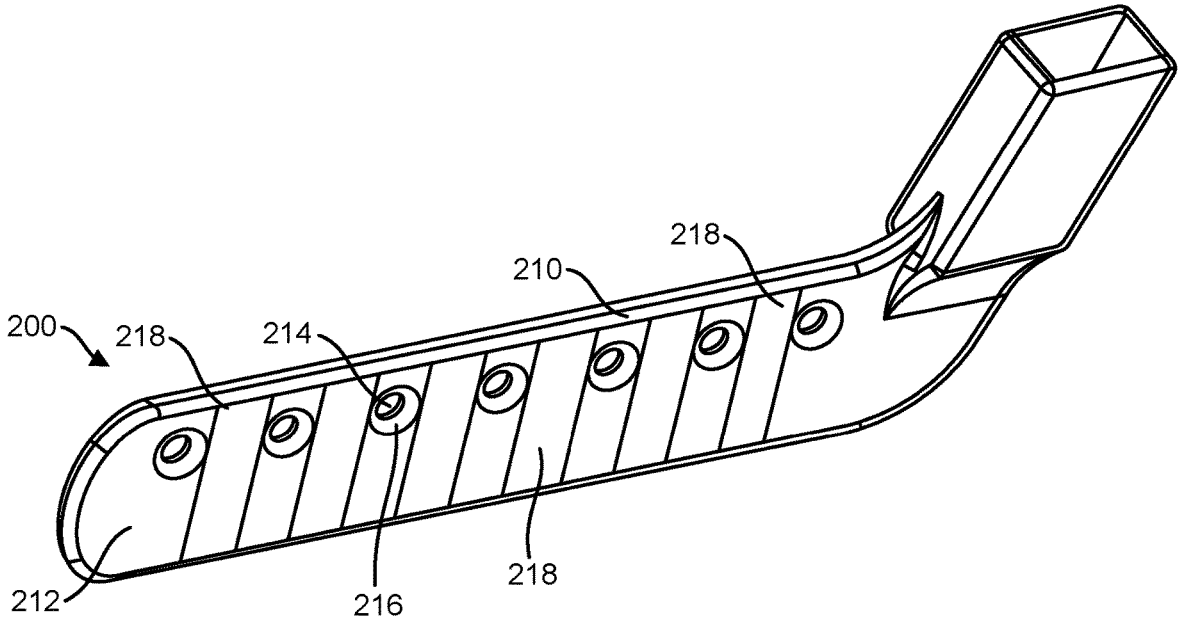
FIG. 7 is a front perspective view of an exemplary hockey stick blade having openings with angled surfaces arranged across a top portion of a playing surface of the blade and grip arranged between the openings, in accordance with various embodiments.

FIG. 4 is a front perspective view of an exemplary hockey stick blade 200 having openings 214 with angled surfaces 216 distributed on a playing surface 212 of the blade 200, in accordance with various embodiments. FIG. 5 is a front perspective view of an exemplary hockey stick blade 200 having openings 214 with angled surfaces 216 arranged across a top portion of a playing surface 212 of the blade 200, in accordance with various embodiments. FIG. 6 is a front perspective view of an exemplary hockey stick blade 200 having openings 214 with angled surfaces 216 arranged across a top portion and grip 218 arranged across a bottom portion of a playing surface 212 of the blade 200, in accordance with various embodiments. FIG. 7 is a front perspective view of an exemplary hockey stick blade 200 having openings 214 with angled surfaces 216 arranged across a top portion of a playing surface 212 of the blade 200 and grip 218 arranged between the openings 214, in accordance with various embodiments.

Referring to FIGS. 4-7, the hockey stick blade 200 may include a blade perimeter edge 210, playing surfaces 212, and openings 214. The playing surfaces 212 may be within the perimeter edge 210 on both sides of the blade 200. The openings 214 may be distributed on the playing surfaces 212 and extend through the blade 200. The openings 214 are surrounded by angled surfaces 216 that may comprise a beveled edge, chamfer, and/or channels to enhance the aerodynamics provided by the openings 214. In certain embodiments, the angled surfaces 216 of the openings 214 may be shaped to enhance air flow through the opening 214.

In various embodiments, the openings 214 may be provided in one or more shapes, such as a tear drop shape, an oval shape, a circular shape, or any suitable shape. In an exemplary embodiment, the openings 214 may be of various sizes and may be evenly or unevenly spaced. For example, the openings 214 may be provided in multiple rows as shown in FIG. 4. As another example, the openings 214 may be distributed in a row adjacent a top perimeter edge 210 of the blade 200 as illustrated in FIGS. 5-7.

In a representative embodiment, the playing surface 212, including areas surrounding one or more of the openings 214, may include tape, grit, or any suitable textured material 218. The textured material 218 may be applied to the playing surface 212 and/or molded into the playing surface 212. For example, the textured material 218 may be applied on one or both of the playing surfaces 212 between a row openings 214 and a lower perimeter edge 210 of the blade 200 as illustrated in FIG. 6. As another example, strips of textured material 218 may be applied to one or both of the playing surfaces 212 between the openings 214 and extending from a top perimeter edge 210 to the bottom perimeter edge 210 of the blade 200 as illustrated in FIG. 7.

The hockey stick blade 200 illustrated in FIGS. 4-7 share various characteristics with the platform tennis paddles illustrated in FIGS. 2-3 as described above.

Figure 8:
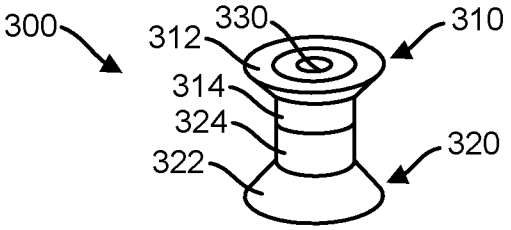
FIG. 8 is a perspective view of an exemplary plug that may be secured in openings extending through sporting equipment to modify the weight and aerodynamics of the sporting equipment, in accordance with various embodiments.
Figure 9:
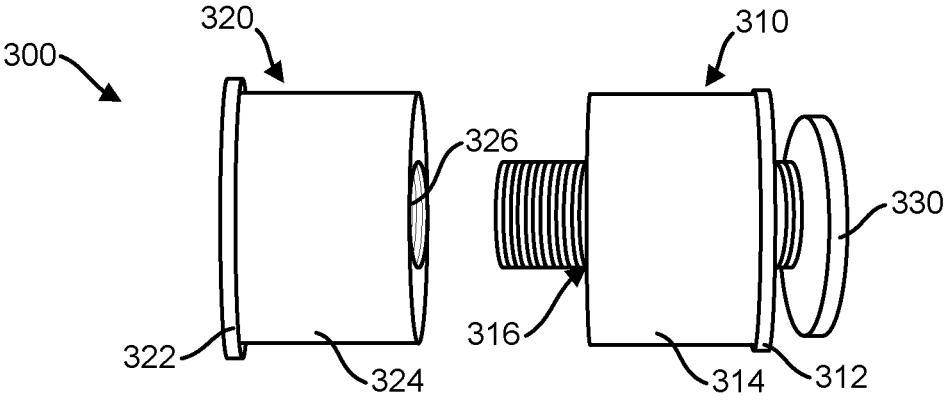
FIG. 9 is a side view of an exemplary plug in an open position, in accordance with various embodiments.

FIG. 8 is a perspective view of an exemplary plug 300 that may be secured in openings 126, 214 extending through sporting equipment 100, 200 to modify the weight and aerodynamics of the sporting equipment 100, 200, in accordance with various embodiments. FIG. 9 is a side view of an exemplary plug 300 in an open position, in accordance with various embodiments. Referring to FIGS. 8-9, the plug 300 may include a first end portion 310, a second end portion 320, and an attachment mechanism 330. The first end portion 310 may include a first outer flange 312 and a first body 314. The second end portion 320 may include a second outer flange 322 and a second body 324. The outer flanges 312, 322 of the first and second end portions 310, 320 may have a diameter that is greater than the diameter of the bodies 314, 324. The outer flanges 312, 322 may be tapered as shown in FIG. 8 or flat as shown in FIG. 9. The body 314 of the first end portion 310 may be configured to align with the body 324 of the second end portion 320.

The attachment mechanism 330 is configured to couple the first end portion 310 to the second end portion 320 such that the plug 300 may be secured within an opening 126, 214 of sporting equipment 100, 200. The attachment mechanism 330 may be a screw, snap, adhesive, or any suitable component for connecting the first and second end portions 310, 320. For example, the first and second end portions 310, 320 may include first and second apertures 316, 326 extending through the end portions 310, 320 and configured to align with each other. The apertures 316, 326 may be threaded and configured to receive a threaded screw or bolt 330 to connect the first and second end portions 310, 320. As an example, the screw or bolt 330 may be rotated to linearly traverse through the aperture 316 of the first end portion 310 and into the aperture 326 of the second end portion 320 to secure the first and second end portions 310, 320 together in a closed position as shown in FIG. 8.

In various embodiments, the plug 300 may be weighted. For example, different sets of plugs 300 may be used to vary the weight and/or balance of the sporting equipment 100, 200. In a representative embodiment, the outer flange 312, 322 (or other outer surface of the plug 300) may be integrated or covered with a decorative cap. The decorative cap may include various colors, symbols, characters, and/or the like. In an exemplary embodiment, an outside surface of the outer flange 312, 322 may be textured.

Additionally and/or alternatively, the plug 300 may be operable to attach to both sides of an opening 126, 214 through sporting equipment 100, 200 by friction, screw, mechanical device, pressure sensitive materials, foam, expanded material, rubbery material, or any suitable connector or material. The plug 300 may completely fill the opening 126, 214, partially fill the opening 126, 214, or cover the opening 126, 214 without filling the opening 126, 214. The plugs 300 can be made so they push through one side of the opening 126, 214, like putty, but are effective on both sides of the opening 126, 214.

Figure 10:
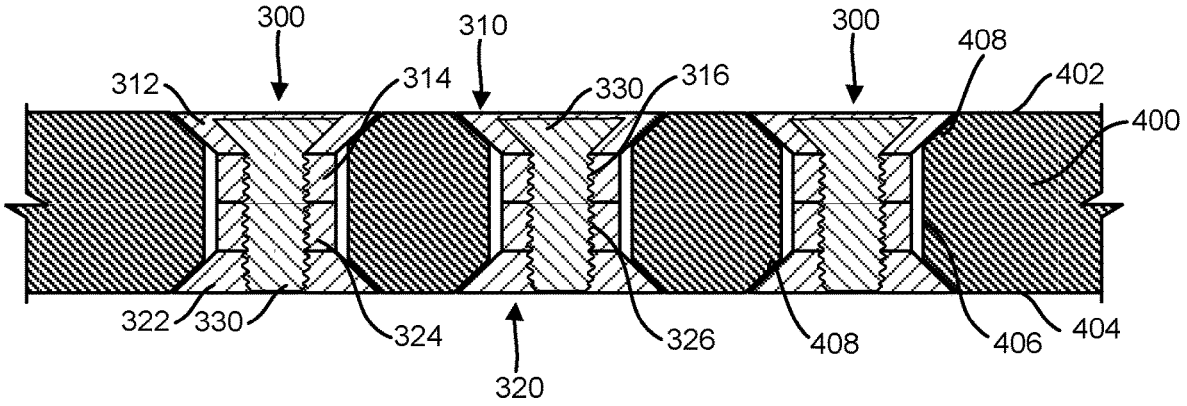
FIG. 10 is a cross-sectional view of an exemplary piece of sporting equipment having plugs secured within openings extending through the equipment to modify the weight and aerodynamics of the equipment, in accordance with various embodiments.

FIG. 10 is a cross-sectional view of an exemplary piece of sporting equipment 400 having plugs 300 secured within openings 406 extending through the equipment 400 to modify the weight and aerodynamics of the equipment 400, in accordance with various embodiments. Referring to FIG. 10, sporting equipment 400, such as the platform tennis paddle 100 of FIGS. 2-3 and the hockey stick blade 200 of FIGS. 4-7, or any suitable sporting equipment, may include a first playing surface 402, a second playing surface 404, and openings 406 extending through the sporting equipment 400. The openings 406 may include angled surfaces or edges 408 on one or both ends of the openings 406 adjacent one or both of the first playing surface 402 and the second playing surface 404.

In certain embodiments, a plug 300 may be selectively placed in one or more of the openings 406 of the sporting equipment 400 to selectively change the air flow through the sporting equipment and/or the weight and/or balance of the sporting equipment 400. The plugs 300 illustrated in FIG. 10 share various characteristics with the plugs 300 illustrated in FIGS. 8-9 as described above. For example, the plugs 300 may include a first end portion 310, a second end portion 320, and an attachment mechanism 330. The end portions 310, 320 may each include an outer flange 312, 322 and a body 314, 324. The outer flanges 312, 322 may have a diameter that is greater than the diameter of the bodies 314, 324. The outer flanges 312, 322 (or other outer surface of the plug 300) may be operable to flushly align with the playing surfaces 402, 404 of the sporting equipment 400. Alternatively, the plugs 300 may sit within the opening 406 or extend beyond the opening 406 of the sporting equipment 400. The attachment mechanism 330 is configured to secure the first end portion 310 to the second end portion 320 within the opening 406 of the sporting equipment 400. The attachment mechanism 330 may be a screw, snap, adhesive, or any suitable component for connecting the first and second end portions 310, 320.

In various embodiments, one or more of the openings 406 in the sporting equipment 400 may be covered and/or at least partially filled with plugs 300. The plugs 300 may be weighted to vary the weight and/or balance of the sporting equipment 400. The plugs 300 may be selectively placed in openings 406 of the sporting equipment 400 to selectively change the air flow through the sporting equipment 400 and/or the weight and/or balance of the sporting equipment 400. In a representative embodiment, the plugs 300 may include or be covered with a decorative cap. The decorative cap may include various colors, symbols, characters, and/or the like.

In an exemplary embodiment, the first end portion 310 of the plug 300 may be inserted into one end of the opening 406 adjacent a first playing surface 402 of the sporting equipment 400. Next, the second end portion 320 of the plug 300 may be inserted into a second end of the opening 406 adjacent a second playing surface 404 of the sporting equipment 400. Next, an attachment mechanism 330, such as a screw, may be linearly traversed through a first aperture 316 extending through the first outer flange 312 and first body 314, and into a second aperture 326 extending through a second body 324 and into the second outer flange 322 to secure the first end portion 310 to the second end portion 320 within the opening 406.

Aspects of the present technology may have a number of benefits, including more aerodynamic sporting equipment, increased speed of the game, improved equipment control, improved equipment aesthetics, and adjustable equipment weight, balance, and aerodynamic properties.

Various embodiments provide systems and methods for selectively enhancing the weight and aerodynamics of sporting equipment 100, 200, 400. A sporting equipment system may comprising a piece of sporting equipment 100, 200, 400 and a plug 300. The piece of sporting equipment 100, 200, 400 may include a plurality of openings 126, 214, 406 extending through the sporting equipment 100, 200, 400. The plug 300 may be operable to be secured within one of the plurality of openings 126, 214, 406 extending through the sporting equipment 100, 200, 400. The plug 300 may comprise a first end portion 310, a second end portion 320, and an attachment mechanism 330. The first end portion 310 may have a first outer flange 312 and a first body 314. The first outer flange 312 may have a larger diameter than the first body 314. The second end portion 320 may have a second outer flange 322 and a second body 324. The second outer flange 322 may have a larger diameter than the second body 324. The attachment mechanism 330 may be configured to connect the first end portion 310 to the second end portion 320 to secure the plug 300 within the one of the plurality of openings 126, 214, 406.

In an exemplary embodiment, the piece of sporting equipment 100, 200, 400 is a platform tennis paddle 100 having a handle portion 110 and a head portion 120. In a representative embodiment, the plurality of openings 126 extend through the head portion 120 of the platform tennis paddle 100. In various embodiments, the head portion 120 of the platform tennis paddle 100 comprises a central portion 130 and a perimeter portion surrounding the central portion 130. The central portion 130 may be a solid playing surface without openings 126. The plurality of openings 126 may be distributed on the perimeter portion surrounding the central portion 130.

In certain embodiments, the piece of sporting equipment 100, 200, 400 is a hockey stick having a hockey stick blade 200. In an exemplary embodiment, the plurality of openings 214 extend through the hockey stick blade 200.

In a representative embodiment, the plurality of openings 126, 214, 406 may each include a first end, a second end, and a central portion. Each of the plurality of openings 126, 214, 406 may include angled edges 128, 216 408 surrounding an outer perimeter of one or both of the first end and the second end. In various embodiments, the angled edges 128, 216 408 are one or both of a chamfer or a beveled edge. In certain embodiments, a diameter of one or both of the first end and the second end is larger than a diameter of the central portion of at least one of the plurality of openings 126, 214, 406. In an exemplary embodiment, an outer surface of the first outer flange 312 is configured to flushly align with a first portion of the piece of sporting equipment 100, 200, 400 surrounding the first end of the one of the plurality of openings 126, 214, 406. Additionally and/or alternatively, an outer surface of the second outer flange 322 is configured to flushly align with a second portion of the piece of sporting equipment 100, 200, 400 surrounding the second end of the one of the plurality of openings 126, 214, 406.

In various embodiments, at least one of the plurality of openings 126, 214, 406 is shaped in a tear drop shape. In certain embodiments, at least one of the plurality of openings 126, 214, 406 is shaped in an oval shape. In an exemplary embodiment, the plurality of openings 126, 214, 406 are evenly spaced on a portion of the piece of sporting equipment 100, 200, 400. In a representative embodiment, the plurality of openings 126, 214, 406 are unevenly spaced on a portion of the piece of sporting equipment 100, 200, 400. In various embodiments, the piece of sporting equipment 100, 200, 400 includes at least one playing surface 124, 212, 402, 404. The plurality of openings 126, 214, 406 may be distributed on the at least one playing surface 124, 212, 402, 404. In certain embodiments, at least a portion of the at least one playing surface 124, 212, 402, 404 comprises a textured surface 218.

In an exemplary embodiment, the plug 300 may comprise a first weight. In a representative embodiment, the sporting equipment system may comprise an additional at least one of the plug 300. The additional at least one of the plug 300 may comprise a second weight that is different than the first weight. In various embodiments, the first end portion 310 may comprise a first threaded aperture 316 extending through the first outer flange 312 and the first body 314. The second end portion 320 may comprise a second threaded aperture 326 extending into at least the second body 324. The attachment mechanism 330 may comprise a threaded member operable to be rotated to linearly traverse through the first threaded aperture 316 and into the second threaded aperture 326 to connect the first end portion 310 to the second end portion 320 to secure the plug 300 within the one of the plurality of openings 126, 214, 406. In certain embodiments, one or both of the first outer flange 312 and the second outer flange 322 may comprise a decorative cap.

As used herein, an element or step recited in the singular and proceeded with the word "a" or "an" should be understood as not excluding the plural of the elements or steps, unless such exclusion is explicitly stated. Furthermore, references to "an embodiment," "one embodiment," "a representative embodiment," "an exemplary embodiment," "various embodiments," "certain embodiments," and the like are not intended to be interpreted as excluding the existence of additional embodiments that also incorporate the recited features. Moreover, unless explicitly stated to the contrary, embodiments "comprising," "including," or "having" an element or a plurality of elements having a particular property may include additional elements not having that property.

As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the term "exemplary" means serving as a non-limiting example, instance, or illustration. As utilized herein, the terms "e.g.," and "for example" set off lists of one or more non-limiting examples, instances, or illustrations. As utilized herein, a component is "operable" to perform a function whenever the component comprises the necessary structure to perform the function, regardless of whether performance of the function is disabled, or not enabled, by some user-configurable option.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed.

What is claimed is:

1. A sporting equipment system comprising:

a piece of sporting equipment comprising a first playing surface side, a second playing surface side opposite the first playing surface side, and a plurality of openings extending through the sporting equipment from the first playing surface side to the second playing surface side of the sporting equipment, wherein:

the plurality of openings each include a first end at the first playing surface side of the sporting equipment, a second end at the second playing surface side of the sporting equipment, and a central portion between the first end and the second end, each of the plurality of openings include angled edges surrounding an outer perimeter of both of the first end and the second end, each of the plurality of openings is configured to receive one of a plurality of plugs, a first subset less than all of the plurality of openings each receive a respective one of the plurality of plugs and a second subset less than all of the plurality openings each remain unfilled by the plurality of plugs to selectively set one or more of a weight, balance, or aerodynamics of the sporting equipment, the piece of sporting equipment is a platform tennis paddle having a handle portion and a head portion, and the plurality of openings extend through the head portion of the platform tennis paddle; and the plurality of plugs, each of the plurality of plugs operable to be secured within one of the plurality of openings extending through the sporting equipment, each of the plurality of plugs comprising:

a first end portion having a first outer flange and a first body, wherein the first outer flange has a larger diameter than the first body, and wherein the first end portion is insertable into the one of the plurality of openings at the first playing surface side of the sporting equipment, a second end portion having a second outer flange and a second body, wherein the second outer flange has a larger diameter than the second body, and wherein the second end portion is insertable into the one of the plurality of openings at the second playing surface side of the sporting equipment, and an attachment mechanism configured to detachably couple to both the first end portion and the second end portion, wherein the attachment mechanism is configured to connect the first end portion to the second end portion to secure the plug within the one of the plurality of openings.

2. The sporting equipment system of claim 1, wherein:

the head portion of the platform tennis paddle comprises a central portion and a perimeter portion surrounding the central portion, the central portion is a solid portion without openings, and the plurality of openings are distributed on the perimeter portion surrounding the central portion.

3. The sporting equipment system of claim 1, wherein the angled edges are one or both of a chamfer or a beveled edge.

4. The sporting equipment system of claim 1, wherein a diameter of one or both of the first end and the second end is larger than a diameter of the central portion of at least one of the plurality of openings.

5. The sporting equipment of claim 1, wherein one or both of:

an outer surface of the first outer flange is configured to flushly align with the first playing surface side of the piece of sporting equipment surrounding the first end of the one of the plurality of openings, and an outer surface of the second outer flange is configured to flushly align with the second playing surface side of the piece of sporting equipment surrounding the second end of the one of the plurality of openings.

6. The sporting equipment system of claim 1, wherein the plurality of openings are evenly spaced on a portion of the piece of sporting equipment.

7. The sporting equipment system of claim 1, wherein the plurality of openings are unevenly spaced on a portion of the piece of sporting equipment.

8. The sporting equipment system of claim 1, wherein at least one of the plurality of openings is both laterally offset from and vertically offset from at least one other of the plurality of openings.

9. The sporting equipment system of claim 8, wherein at least a portion of the first playing surface side and/or at least a portion of the second playing surface side comprises a textured surface.

10. The sporting equipment system of claim 1, wherein a first one of the plurality of plugs comprises a first weight.

11. The sporting equipment system of claim 10, wherein a second one of the plurality of plugs comprises a second weight that is different than the first weight.

12. The in sporting equipment system of claim 1, wherein:

the first end portion comprises a first threaded aperture extending through the first outer flange and the first body, the second end portion comprises a second threaded aperture extending into at least the second body, and the attachment mechanism comprises a threaded member operable to be rotated to linearly traverse through the first threaded aperture and into the second threaded aperture to connect the first end portion to the second end portion to secure the plug within the one of the plurality of openings.

13. The sporting equipment system of claim 1, wherein one or both of the first outer flange and the second outer flange comprises a decorative cap.

14. A sporting equipment system comprising:

a piece of sporting equipment comprising a first playing surface side, a second playing surface side opposite the first playing surface side, and a plurality of openings extending through the sporting equipment from the first playing surface side to the second playing surface side of the sporting equipment, wherein:

the plurality of openings each include a first end at the first playing surface side of the sporting equipment, a second end at the second playing surface side of the sporting equipment, and a central portion between the first end and the second end, each of the plurality of openings include angled edges surrounding an outer perimeter of both of the first end and the second end, each of the plurality of openings is configured to receive one of a plurality of plugs, a first subset less than all of the plurality of openings each receive a respective one of the plurality of plugs and a second subset less than all of the plurality openings each remain unfilled by the plurality of plugs to selectively set one or more of a weight, balance, or aerodynamics of the sporting equipment, the piece of sporting equipment is a hockey stick having a hockey stick blade, and the plurality of openings extend through the hockey stick blade; and the plurality of plugs, each of the plurality of plugs operable to be secured within one of the plurality of openings extending through the sporting equipment, each of the plurality of plugs comprising:

a first end portion having a first outer flange and a first body, wherein the first outer flange has a larger diameter than the first body, and wherein the first end portion is insertable into the one of the plurality of openings at the first playing surface side of the sporting equipment, a second end portion having a second outer flange and a second body, wherein the second outer flange has a larger diameter than the second body, and wherein the second end portion is insertable into the one of the plurality of openings at the second playing surface side of the sporting equipment, and an attachment mechanism configured to detachably couple to both the first end portion and the second end portion, wherein the attachment mechanism is configured to connect the first end portion to the second end portion to secure the plug within the one of the plurality of openings.

15. The sporting equipment system of claim 14, wherein the angled edges are one or both of a chamfer or a beveled edge.

16. The sporting equipment system of claim 14, wherein a diameter of one or both of the first end and the second end is larger than a diameter of the central portion of at least one of the plurality of openings.

17. The sporting equipment of claim 14, wherein one or both of:

an outer surface of the first outer flange is configured to flushly align with the first playing surface side of the piece of sporting equipment surrounding the first end of the one of the plurality of openings, and an outer surface of the second outer flange is configured to flushly align with the second playing surface side of the piece of sporting equipment surrounding the second end of the one of the plurality of openings.

18. The sporting equipment system of claim 14, wherein the plurality of openings are evenly spaced on a portion of the piece of sporting equipment.

19. The sporting equipment system of claim 14, wherein the plurality of openings are unevenly spaced on a portion of the piece of sporting equipment.

20. The sporting equipment system of claim 14, wherein at least one of the plurality of openings is both laterally offset from and vertically offset from at least one other of the plurality of openings.

21. The sporting equipment system of claim 20, wherein at least a portion of the first playing surface side and/or at least a portion of the second playing surface side comprises a textured surface.

22. The sporting equipment system of claim 14, wherein a first one of the plurality of plugs comprises a first weight.

23. The sporting equipment system of claim 22, wherein a second one of the plurality of plugs comprises a second weight that is different than the first weight.

24. The in sporting equipment system of claim 14, wherein:

the first end portion comprises a first threaded aperture extending through the first outer flange and the first body, the second end portion comprises a second threaded aperture extending into at least the second body, and the attachment mechanism comprises a threaded member operable to be rotated to linearly traverse through the first threaded aperture and into the second threaded aperture to connect the first end portion to the second end portion to secure the plug within the one of the plurality of openings.

25. The sporting equipment system of claim 14, wherein one or both of the first outer flange and the second outer flange comprises a decorative cap.

* * * * *